United States Patent [19]

Gelhaar et al.

[11] 4,155,792

[45] May 22, 1979

[54] PROCESS FOR PRODUCING A HONEYCOMB OF SYNTHETIC-RESIN MATERIAL FOR USE IN AN ELECTROSTATIC PRECIPITATOR

[75] Inventors: Rolf Gelhaar, Weilrod; Wolfgang Hartmann, Bergen Enkheim, both of Fed. Rep. of Germany

[73] Assignee: Metallgesellschaft Aktiengesellschaft, Frankfurt am Main, Fed. Rep. of Germany

[21] Appl. No.: 831,995

[22] Filed: Sep. 9, 1977

[30] Foreign Application Priority Data

Sep. 13, 1976 [DE] Fed. Rep. of Germany ..... 2641114

[51] Int. Cl.[2] ..... B65H 81/00; B03C 3/45

[52] U.S. Cl. ..... 156/172; 55/156; 55/DIG. 38; 156/182; 156/222; 156/245; 428/118; 428/184

[58] Field of Search ..... 428/116, 73, 118, 178, 428/188, 182, 183, 184; 156/172, 182, 210, 205, 197, 222, 196, 221, 245, 242, 224; 55/101, 154, DIG. 38, 122, 131, 156; 261/112; 252/477 R

[56] References Cited

U.S. PATENT DOCUMENTS

| | | | |
|---|---|---|---|
| 2,997,519 | 8/1961 | Hines et al. | 55/DIG. 38 |
| 3,234,972 | 2/1966 | Koppelman et al. | 428/118 |
| 3,240,644 | 3/1966 | Wolff | 156/172 |
| 3,248,275 | 4/1966 | Lincoln | 428/116 |
| 3,661,670 | 5/1972 | Pierpent, Jr. | 156/172 |
| 3,673,058 | 6/1972 | Jackson et al. | 428/118 |
| 3,740,301 | 6/1973 | Manning et al. | 428/116 |
| 3,784,429 | 1/1974 | Muller | 156/175 |
| 3,793,802 | 2/1974 | Hardt | 55/DIG. 38 |
| 3,950,115 | 4/1976 | Euler | 428/116 |

*Primary Examiner*—Michael W. Ball
*Attorney, Agent, or Firm*—Karl F. Ross

[57] ABSTRACT

A process for producing a honeycomb of synthetic-resin material for use as the collector electrode of an electrostatic precipitator comprises assembling the honeycomb from plate strips having the cross section of sheet piling and made by hot molding from unsaturated polyester resins, glass fibers and nonwoven external covering fabrics of synthetic fiber. The honeycomb structure, which has a hexagonal ducts, is then provided with a shell of glass fiber and polyester resin by a winding operation. Conductive pigments, such as carbon and metal oxides, and flame-inhibiting additives can be incorporated in the unsaturated polyester resin.

3 Claims, 7 Drawing Figures

CORONA-DISCHARGE WIRE
W

5
S
8
7a
$L_2$
$L_1$
8
6
9
7b

PROCESS FOR PRODUCING A HONEYCOMB OF SYNTHETIC-RESIN MATERIAL FOR USE IN AN ELECTROSTATIC PRECIPITATOR

FIELD OF THE INVENTION

The present invention relates to a process for producing a honeycomb of synthetic-resin material for use in an electrostatic precipitator.

BACKGROUND OF THE INVENTION

To separate fog or liquid particles from the exhaust gases of chemical processes, it is known to use so-called tubular electrostatic precipitators, which comprise a bundle of tubes or ducts, which are similar in cross-section and define parallel flow paths for the gas. In each tube or duct, a taut wire is concentrically disposed. This wire is connected to one terminal of a source of a high d.c. voltage whose other terminal is connected to the walls of the flow path. In the operation of the precipitator, the electrostatic field which effects the separation is established between the wire and the surrounding surface of the tube or duct.

It is also known to use synthetic-resin material tubes in electrostatic precipitators for separating corrosive particles of fog or liquid. While tubes of synthetic-resin material have a high resistance to corrosion, they cannot be used at elevated temperatures. For example, it is not possible to use tubes of PVC-S at temperatures above 60° C., tubes of polypropylene and composite tubes of PVC and glass fiber-reinforced plastics material at temperatures above about 75° C., and tubes of PVC-HT at temperatures above about 80° C.

With tubes made of PVC-S and PVC-HT, the relaxation tendencies must also be considered since even at temperatures below those mentioned above, significant deformation may occur so that the tolerances regarding dimensions and disposition can no longer be adhered to. These tolerances are very small in order to ensure optimum electrostatic conditions. Failure to adhere to the tolerances considerably detracts from the usefulness of the precipitator and can possibly result in failure thereof.

While the relaxation can be fairly well controlled with composite tubes consisting of thermoplastics and of synthetic-resin material reinforced with glass fibers, the use of such tubes involves other difficulties. For example, different coefficients of expansion give rise to considerable stress in the composite and lead to cracking thereof. Through these cracks, any corrosive liquid which has been precipitated can penetrate the composite and destroy the support structure. Because the structural elements of the electrostatic precipitator are relatively large, the required dimensional tolerances often can be adhered to only with great difficulty in view of the properties of the material and the technology used to process the same.

Most synthetic-resin materials are also very good electrical insulators. While this property is highly desirable in many cases in which synthetic-resin materials are used, it is entirely undesirable in electrostatic precipitators. Although the collector electrodes need not be electrically conducting when it is desired to separate fog and liquid particles, because the film of moisture deposited on said collector electrodes constitutes on the surface of the inherently insulating material a layer having a sufficiently high electrical conductivity, this is only a "pseudo-conductivity", depending upon the formation of a continuous liquid film, i.e. on a correspondingly high moisture content of the flowing gas at all times.

Those synthetic-resin elements which consist of weldable thermoplastics are joined by welding.

Synthetic-resin elements consisting of composite material, such as PVC and glass fiber-reinforced synthetic resins, are sometimes joined by the synthetic resin, which is applied in a liquid state to the thermoplastic material, and partly by the reinforcing materials, such as glass fiber mats, which are embedded in the synthetic resin. These manufacturing operations are performed almost exclusively by hand and are highly expensive. Experience has shown that these techniques do not always result in a homogeneous structure of the material.

OBJECTS OF THE INVENTION

It is the principal object of the present invention to provide a process for the production of a honeycomb of synthetic-resin material for use as the conductor electrode in an electrostatic precipitator.

Another object of this invention is to provide a process for the purposes described which is free from the disadvantages mentioned previously and characterizing other systems of producing the tubular structure of a tube-type electrostatic precipitator.

It is also an object of this invention to provide an improved process for making a honeycomb structure for use in a tube-type electrostatic precipitator.

SUMMARY OF THE INVENTION

It has been found that these objects can be attained in that plate strips having the cross-section of sheet piling are made first by hot molding from unsaturated polyester resins, glass fibers, and non-woven external covering fabrics of synthetic fibers, these plate strips are subsequently assembled to form a honeycomb structure having hexagonal ducts, and the honeycomb structure is provided with a shell of glass fibers and polyester resin by a winding operation.

A plate strip having the cross section of sheet piling, according to the invention, is an elongated strip formed with a central portion of generally trapezoidal cross section with a small base of the trapezoid connected to a pair of converging legs. The broad base of the trapezoid is open and lies in a plane which coincides with the plane of a pair of outwardly turned flanges extending from each of these legs. It will be apparent that two such strips, rotated with respect to one another through 180°, can define a honeycomb cell, i.e. a hexagonal channel.

Conducting pigments, such as carbon, metal oxides, or the like, and flame-inhibiting additives can be incorporated in the unsaturated polyester resins. The manufacturing process is suitably carried out in such a manner that a non-woven covering fabric, a glass fiber mat, and another non-woven covering fabric are placed in a mold. A measured quantity of liquid unsaturated polyester resin, which can contain additives as desired, is then introduced, and plate strips having the cross-section of sheet piling are then formed by hot molding.

In another embodiment of the invention, a non-woven covering fabric, a mat consisting of glass fibers and substantially unsaturated polyester resin, and a second non-woven covering fabric are placed in a mold and are then hot-molded to form plate strips having the cross-section of sheet piling.

When the plate strips are assembled to form a honeycomb structure, the plate strips can be adhesively joined by means of an adhesive which contains the same resin.

In accordance with a further feature of the invention, the voids between the honeycomb structure and the wound shell are filled with material which is foamed in these voids. During the manufacture of the shell it is desirable to wind the shell material around flanges and hangers or fixing means to hold the same in position. To ensure an overlap between the plate strips forming the honeycomb structure, the plate strips having the shape of sheet piling are provided with free edge flanges having different widths.

In the process according to the invention, the plate strips can be manufactured with such dimensional stability that they can be assembled without difficulty to form large honeycomb structures. The overall size can be increased as desired in that plate strips are assembled which overlap in the longitudinal and transverse directions and an upper size limit is imposed only by the handling facilities. The manufacturing process according to the invention has also the advantage that virtually complete precipitator units can be made in the workshop so that the assembling work required on the site is reduced and any errors in assembling are virtually precluded. The winding of the shell material around the honeycomb structure results in a highly stable unit. A good bond and a good cohesion are ensured by the fact that the wound shell material shrinks to some extent as it is cured.

A sufficiently high electrical conductivity is imparted to the plate strips by the addition of conducting pigments to the resin. The flame-inhibiting additives prevent a burning of the precipitator even upon development of an electrical discharge which could otherwise inherently ignite the honeycomb structure.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
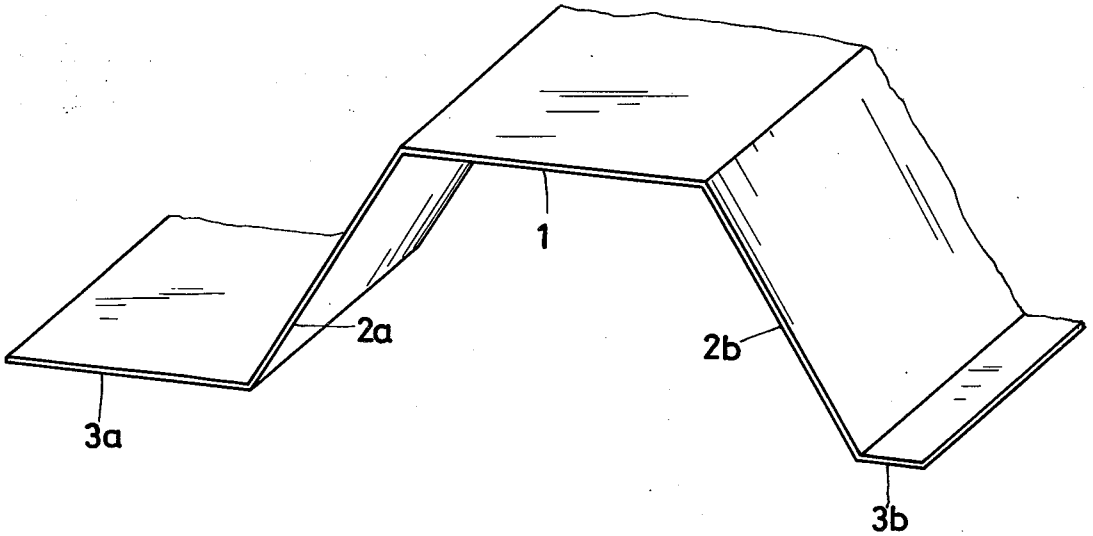
FIG. 1 is a perspective view showing a plate strip having the shape of sheet piling.

The plate strip shown in FIG. 1 has in cross-section the configuration of a trapezoid and comprises a base 1 and two limbs 2a and 2b, each of which includes an angle of 120° with the base 1 and has substantially the same length as the latter. The base and the limbs together form one-half of a hexagon so that two such plate strips having the shape of sheet piling can be assembled to form a hexagonal duct.

Each of the limbs 2a and 2b is continued by a flange 3a or 3b. These flanges are parallel to the base 1. The width of flange 3a is four times the width of the flange 3b. The total length of both flanges 3a and 3b is approximately as large as the length of the base. The flanges are asymmetrical so that there will be an overlap at the joints between the plate strips assembled to form a honeycomb even when the plate strips have been turned through 180°.

Figure 2:
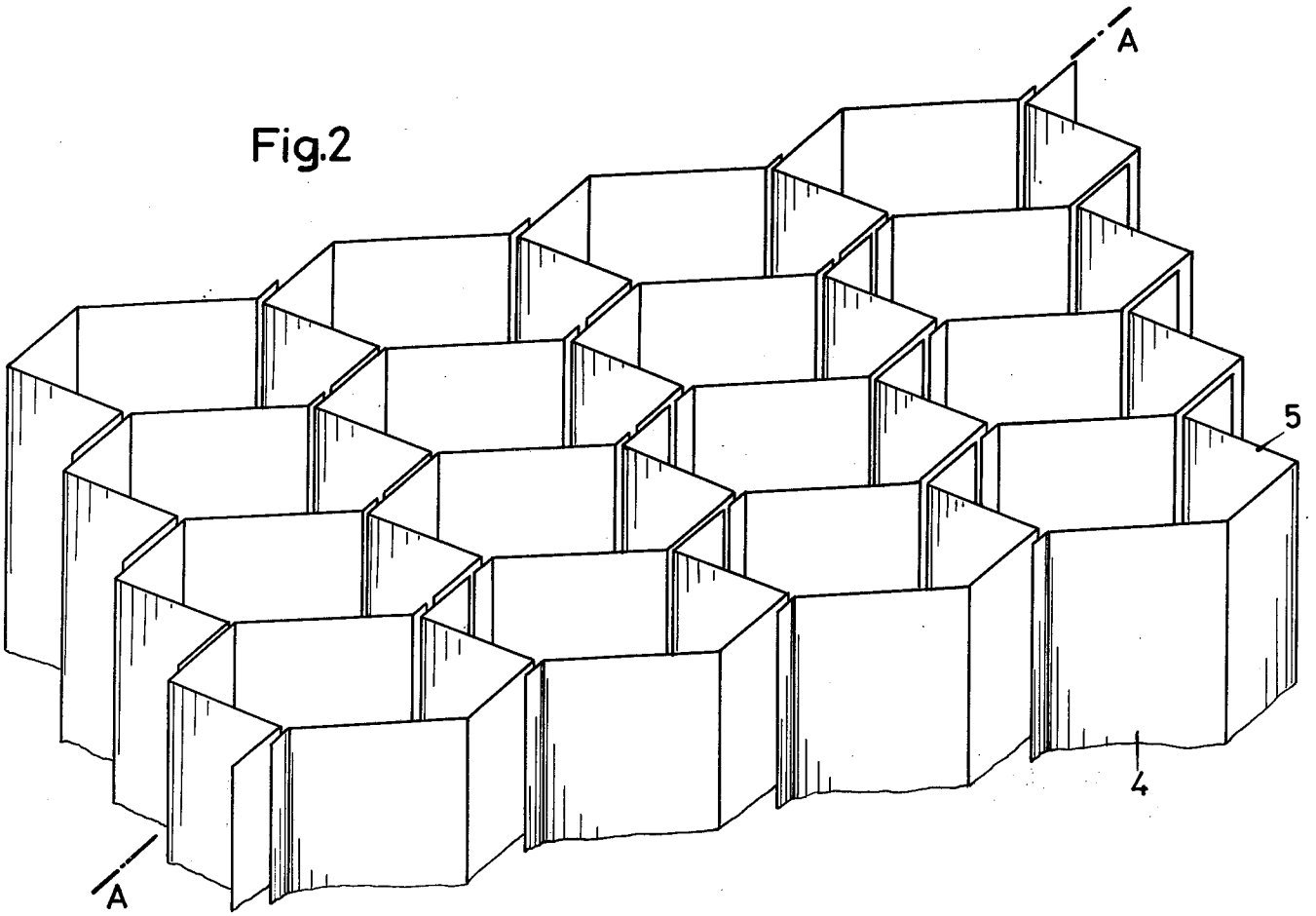
FIG. 2 is a fragmentary view showing a portion of a honeycomb structure.

FIG. 2 shows how the plate strips 4 having the shape of sheet piling have been assembled to form a honeycomb structure. It is desirable to use plate strips differing in length (see $L_1$ and $L_2$) so that a plurality of plate strips can be disposed one behind the other in such a manner that the joints between plate strips are on different levels. It is apparent along line A-A that the asymmetric flanges 3a and 3b ensure an overlap at the joints even between plate strips which have been turned through 180° relative to each other. With reference to a plane of symmetry, such as A—A, a honeycomb structure is suitably assembled in such a manner that only plate strips having the same orientation are used on one side of that plane and all plate strips used on the other side of the plane are turned through 180° about their longitudinal axis relative to the plate strips on the first-mentioned side. FIG. 2 shows also clearly how hexagonal ducts 5 are formed by the assembled plate strips 4.

Figure 3:
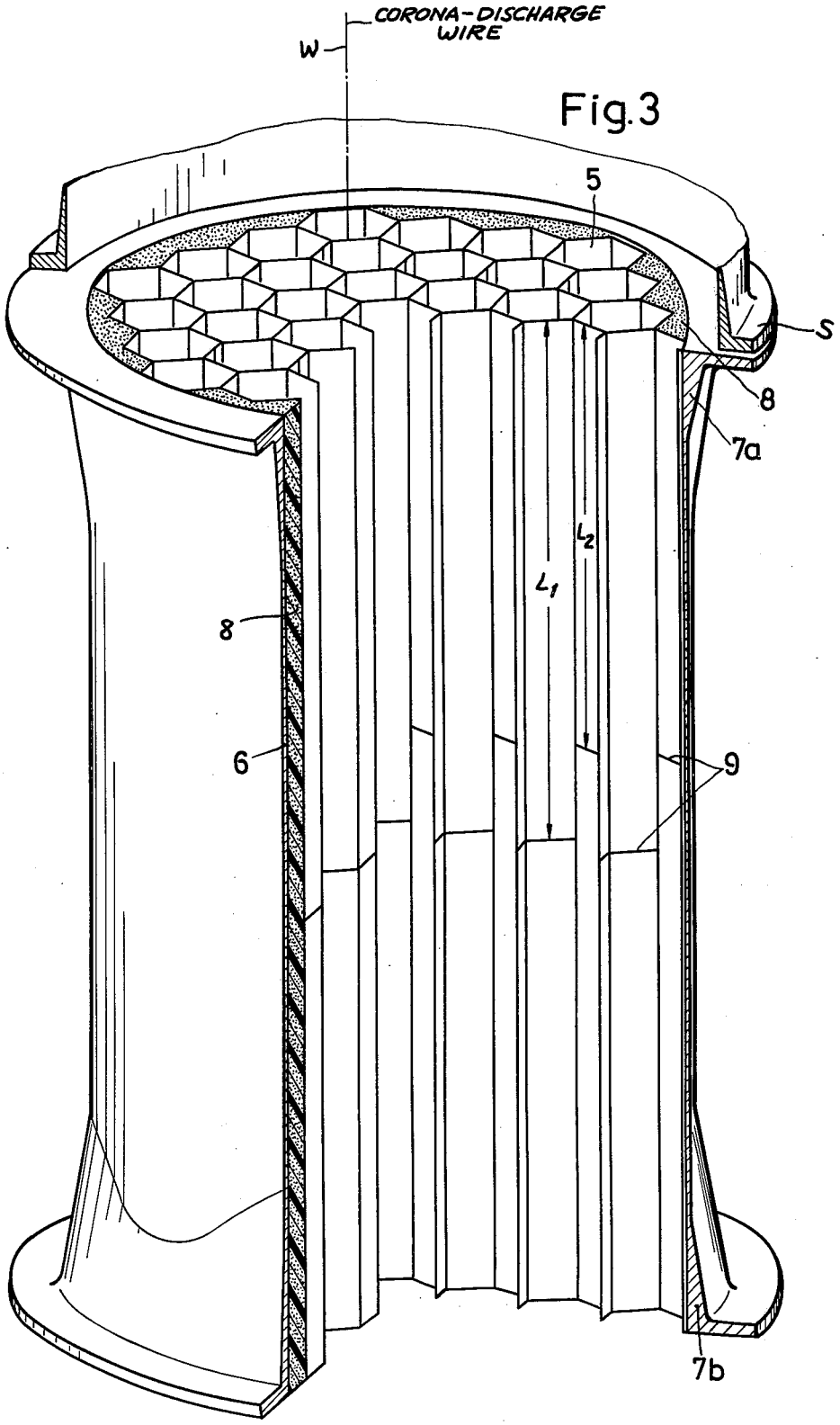
FIG. 3 is a perspective view, partly broken away, which shows an electrostatic precipitator comprising a honeycomb of synthetic resin material.

FIG. 3 shows the complete honeycomb, which can be used as a collector electrode, together with the shell, fixing flanges 7a and 7b, and a foamed in-situ filling 8 between the outside surfaces of the hexagonal ducts 5 at the periphery of the honeycomb structure and the substantially circular shell 6. From the part shown in section, it is apparent that each of the hexagonal ducts 5 is formed by two plate strips, which have been joined at their longitudinal side edges. When plate strips differing in lengths are employed, the joints 9 may be arranged on different levels.

In FIG. 3, the corona-discharge wire which passes centrally through each of the hexagonal cells or ducts 5 has been shown at W. One such wire is provided for each cell and the wires are held taut between support structures one of which has been illustrated at S. In operation, the mist-containing gas stream is caused to pass through the ducts or cells 5, e.g. by blower means not shown while a high direct-current voltage is applied across the array of wires W and the collector assembly formed by the cells 5. The droplets wet the surfaces of the collector electrode and the separated dust and droplets are recovered at the bottom. Purified gas is obtained at the top of the electrostatic precipitator.

Figure 4:
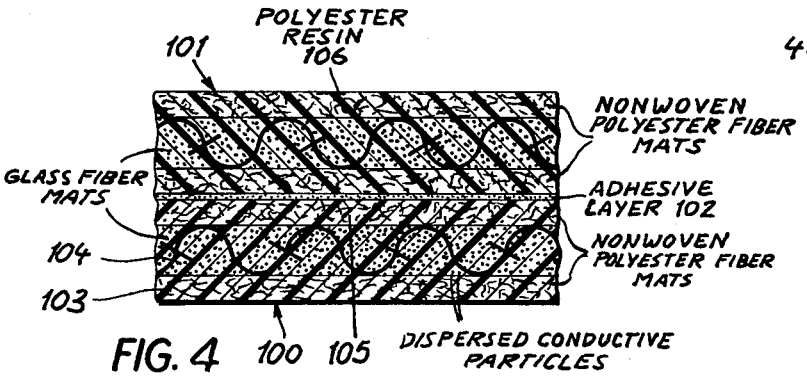
FIG. 4 is a cross-sectional view, greatly enlarged, representing a detail of a plate strip according to the present invention at its junction with another plate strip.

FIG. 4 shows, in diagrammatic form, the structure of each of the plate strips. From this Figure it will be apparent that, in cross-section, each plate strip 100 can be composed of a central glass fiber mat 104 and a pair of nonwoven polyester fiber mats 103 and 105 flanking the glass fiber mat, the entire assembly being impregnated with synthetic resin 106 in which is dispersed conductive particles or the other additive materials described. The synthetic resin 106 is an unsaturated polyester resin. The strip 100 can be bonded by an adhesive layer 102 to the adjacent strip 101 to form the honeycomb structure in the manner previously described.

Figure 5:
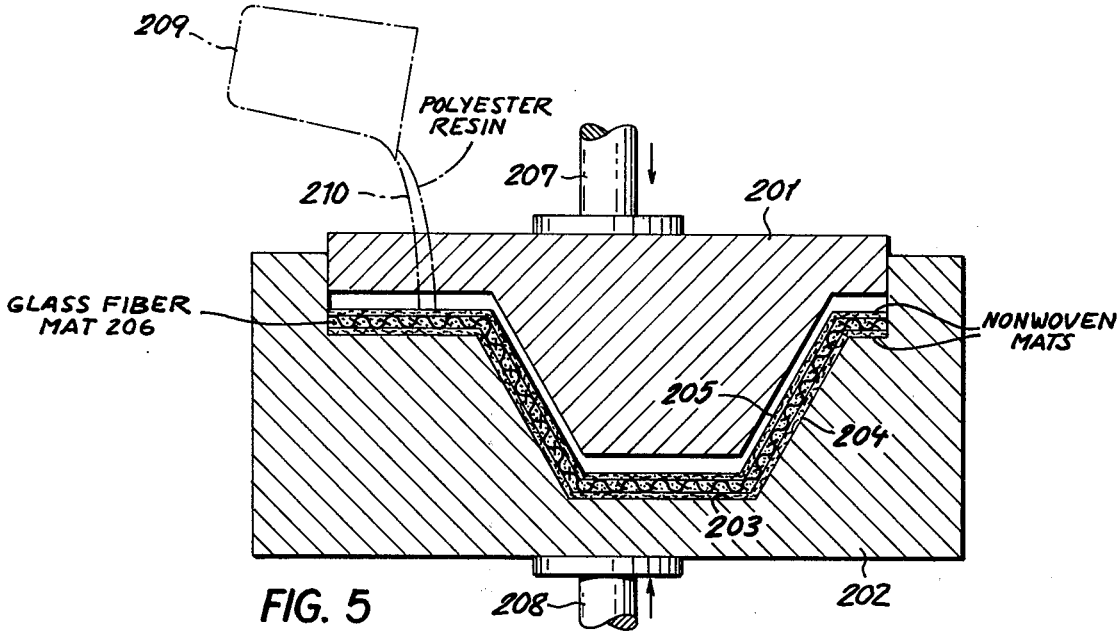
FIG. 5 is a cross-sectional view illustrating one embodiment of the formation of the plate strip according to the present invention.

From FIG. 5 it will be apparent that the plate strips of the present invention can be formed by laying into the lower mold member 202 which is provided with a mold cavity 203 of the desired shape of the strip, the nonwoven mats 204 and 205 which flank the glass fiber mat 206. The synthetic-resin material can then be poured at 210 from a container 209 into the mold to impregnate the assembly of mats. The upper mold member 201 can then be applied to the material in the mold and the contents of the mold subjected to hot-pressing, i.e. heating of the mold and pressure in a press which has been represented at 207 and 208.

Figure 6:
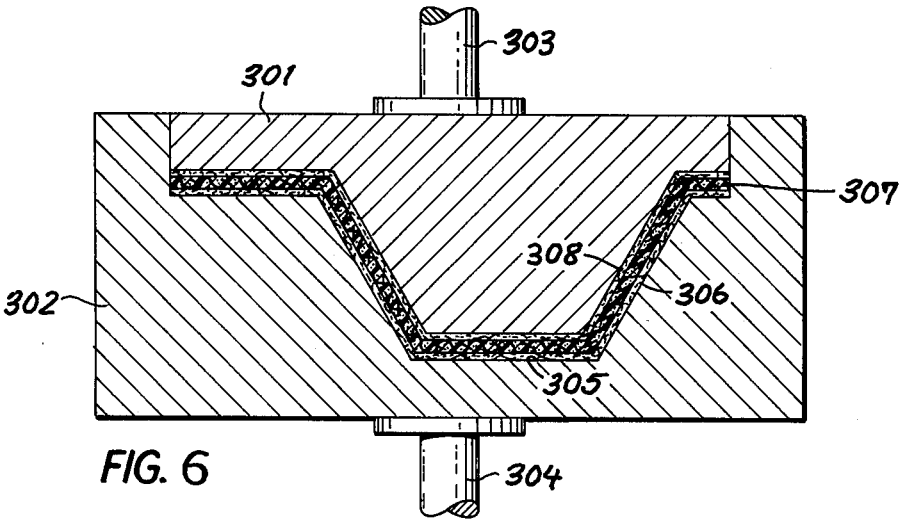
FIG. 6 is a cross-sectional view illustrating another embodiment of the fabrication of a plate strip.

In an alternative embodiment of the present invention (FIG. 6), a glass fiber web 307 impregnated previously with the synthetic resin, is laid into the mold 302 and is flanked by cover sheets 306 and 308 which have not been impregnated initially. The upper mold member 301 is then applied with pressure being supplied at 303, 304 with heating to induce the synthetic-resin material to flow throughout the mold cavity 305 and impregnate the nonwoven mats 306 and 308.

Figure 7:
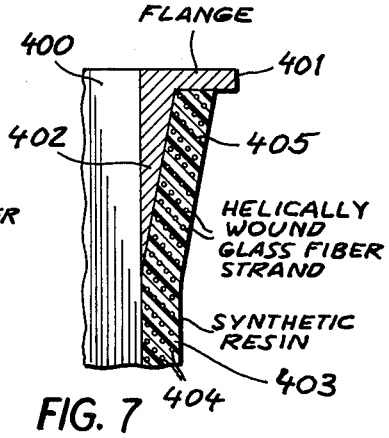
FIG. 7 is a detail view showing the winding operation forming the outer shell of the electrostatic precipitator.

The winding operation can be a conventional glass-fiber-strand winding or a winding of glass-fiber webs impregnated with polyester synthetic resin as shown in FIG. 7. In this case, the glass-fiber strands have been represented at 404 and the synthetic resin at 403. The winding is effected such that the shell structure overlies, at 405 portions 402 of the flange 401 adapted to be incorporated in the shell of the electrostatic precipitator whose honeycomb structure is represented at 400.

We claim:

1. A process for producing a honeycomb collector structure for an electrostatic precipitator, comprising:

(a) forming plate strips by introducing glass fiber mats covered on both sides by nonwoven mats of synthetic fibers into a mold and filling the mold with a liquid unsaturated polyester resin, said strips each comprising a planar base, a pair of planar shanks diverging from and adjoining said base and a pair of flanges of different widths each attached to and extending outwardly from a respective shank parallel to said base whereby said shanks and said base together define half of an equilateral hexagonal honeycomb channel, the sum of the widths of said flanges being substantially equal to the width of said base;

(b) assembling said strips into a honeycomb configuration with hexagonal ducts by bonding the broader flange of a first of said strips and the narrower flange of a second of said strips against the base of a third of said strips and bonding still other broad and narrow flanges in overlapping relationship with the narrow and broad flanges of further strips, respectively; and (c) winding a shell of glass fibers and polyester resin about said honeycomb configuration to enclose the same.

2. The process defined in claim 1 wherein the plate strips are bonded together with a material of the same resin type as is used to fill the mold.

3. The process defined in claim 1, further comprising incorporating in said shell, flanges at the ends thereof at least in part by winding glass fibers therearound and embedding the flanges in said shell.

* * * * *